US007861500B2

(12) United States Patent
Bennett

(10) Patent No.: US 7,861,500 B2
(45) Date of Patent: Jan. 4, 2011

(54) AUTOMATIC CART BAGGER

(76) Inventor: Bradley Arthur Bennett, N621 County Road F #35, Montello, WI (US) 53949-8847

( * ) Notice: Subject to any disclaimer, the term of this patent is extended or adjusted under 35 U.S.C. 154(b) by 70 days.

(21) Appl. No.: 12/172,634

(22) Filed: Jul. 14, 2008

(65) Prior Publication Data

US 2010/0005761 A1 Jan. 14, 2010

(51) Int. Cl.
*B65B 9/10* (2006.01)

(52) U.S. Cl. ..... 53/567; 53/459; 53/75

(58) Field of Classification Search ..... 53/459, 53/457, 441, 564, 567, 64, 67, 75
See application file for complete search history.

(56) References Cited

U.S. PATENT DOCUMENTS

| | | | | | |
|---|---|---|---|---|---|
| 3,707,064 | A * | 12/1972 | Mucka et al. | ..... | 53/567 |
| 3,902,303 | A * | 9/1975 | King | ..... | 53/556 |
| 3,925,964 | A * | 12/1975 | Birkenfeld et al. | ..... | 53/567 |
| 3,961,459 | A * | 6/1976 | Wolske | ..... | 53/436 |
| 4,050,219 | A * | 9/1977 | Higgins | ..... | 53/567 |
| 4,063,401 | A * | 12/1977 | Higgins | ..... | 53/567 |
| 4,064,678 | A * | 12/1977 | Grocke | ..... | 53/567 |
| 4,309,861 | A * | 1/1982 | Karpisek | ..... | 53/556 |
| 4,473,990 | A * | 10/1984 | Thimon | ..... | 53/567 |
| 4,546,598 | A * | 10/1985 | Karpisek | ..... | 53/556 |
| 4,580,391 | A * | 4/1986 | Tetenborg et al. | ..... | 53/375.7 |
| 4,724,658 | A * | 2/1988 | Birkenfeld et al. | ..... | 53/557 |
| 5,247,783 | A * | 9/1993 | Hannen | ..... | 53/567 |
| 5,692,363 | A * | 12/1997 | Inman et al. | ..... | 53/567 |
| 6,032,439 | A * | 3/2000 | Birkenfeld et al. | ..... | 53/441 |
| 6,298,636 | B1 * | 10/2001 | Lachenmeier et al. | ..... | 53/442 |
| 6,470,654 | B1 * | 10/2002 | Lachenmeier et al. | ..... | 53/567 |
| 6,516,587 | B1 * | 2/2003 | Chikatani | ..... | 53/459 |
| 6,662,535 | B2 * | 12/2003 | Pin | ..... | 53/556 |
| 6,865,865 | B2 * | 3/2005 | Hannen et al. | ..... | 53/567 |
| 7,040,076 | B2 * | 5/2006 | Lachenmeier et al. | ..... | 53/441 |
| 7,234,289 | B2 * | 6/2007 | Hannen et al. | ..... | 53/441 |
| 7,290,382 | B2 * | 11/2007 | Imao | ..... | 53/570 |
| 7,603,833 | B2 * | 10/2009 | Koke | ..... | 53/468 |
| 2005/0229547 | A1 * | 10/2005 | Koke | ..... | 53/468 |

* cited by examiner

*Primary Examiner*—Paul R Durand

(57) ABSTRACT

A method of automatically placing a bag over an object and removing the bag from a bag dispenser is provide. Fold grippers mounted to an arm support frame positioned at a first location on a frame are closed on folds of a first bag. A fold gripper is moved from a first location to a second location on the arm support frame opening the first bag. The arm support frame is moved from the first location to a second location on the frame to cover the object. The fold grippers are opened after moving the arm support frame to the second location. The arm support frame is moved from the second location to the first location on the frame. The fold gripper is moved from the second location to the first location on the arm support frame. Bag grippers mounted to the arm support frame are closed on the first bag. The fold grippers are closed on the folds of a second bag attached to the first bag. The fold gripper is moved from the first location to the second location on the arm support frame separating the bags and opening the second bag.

14 Claims, 12 Drawing Sheets

AUTOMATIC CART BAGGER

FIELD

The field of the disclosure relates generally to an automated system for positioning a bag over an object and separating the bag from a bag roll.

BACKGROUND

Linen carts are widely used to transport cleaned linens and other products such as scrub garments, patient gowns, and other washable cloth items for hospitals, health clinics, and other institutions. Before the linen carts are transported they must be covered with a protective barrier to insure that the materials remain sterile. Typically, the protective barrier is a disposable plastic bag positioned to cover the linen cart. To cover the linen cart with the plastic bag, the linen cart is manually positioned parallel to a roll of plastic bags mounted in a bag feed system. To cover the linen cart with a bag, a person reaches above a first end of the linen cart, opens the bag, and pulls the bag partially down over the first end of the linen cart. The person then moves to the opposite end of the linen cart and reaches above the linen cart to open the opposite end of the bag. The person then pulls the bag partially down over the second end of the linen cart. The person moves back to the first end of the cart and pulls the bag further down until the perforations which separate the current bag from the next bag on the bag roll is positioned directly above the cart. The person then reaches up and grabs the current bag below the perforation and grabs the next bag above the perforation. After gripping the current and next bags, the person pulls upward and downward moving along the length of the linen cart to completely separate the current bag from the next bag on the bag roll. The current process causes neck, shoulder, and back strain in the individuals who must repeatedly perform the task of covering the linen carts each day resulting in slower productivity, lost work time due to injury, and compensation claims. Thus, what is needed is a method and a system for automatically placing a bag over an object such as a linen cart and separating the bag from a bag roll.

SUMMARY

In yet another exemplary embodiment, a device is provided. The device includes, but is not limited to, a frame, an arm support frame, a plurality of fold grippers, a plurality of bag grippers, a processor, and a computer-readable medium. The arm support frame is movably mounted to the frame. The plurality of fold grippers are mounted to the arm support frame. At least one of the plurality of fold grippers is movably mounted to the arm support frame. The plurality of bag grippers are mounted to the arm support frame. The computer-readable medium includes computer-readable instructions stored therein that, upon execution by the processor, perform operations comprising closing the plurality of fold grippers on a plurality of folds of a first bag; moving at least one of the plurality of fold grippers from a first location relative to the arm support frame to a second location relative to the arm support frame thereby opening the first bag; moving the arm support frame from a first location on the frame to a second location on the frame so that the first bag covers an object; opening the plurality of fold grippers after moving the arm support frame to the second location on the frame; moving the arm support frame from the second location on the frame to the first location on the frame; moving the at least one of the plurality of fold grippers from the second location relative to the arm support frame to the first location relative to the arm support frame; closing the plurality of bag grippers on the first bag; closing the plurality of fold grippers on the plurality of folds of a second bag attached to the first bag; and moving the at least one of the plurality of fold grippers from the first location relative to the arm support frame to the second location relative to the arm support frame to separate the first bag from the second bag and open the second bag.

In an exemplary embodiment, a method of automatically placing a bag over an object and removing the bag from a bag dispenser is provided. A plurality of fold grippers are closed on a plurality of folds of a first bag using a first actuator. The plurality of fold grippers are mounted to an arm support frame positioned at a first location on a frame. At least one of the plurality of fold grippers is moved using a second actuator from a first location on the arm support frame to a second location on the arm support frame thereby opening the first bag. The arm support frame is moved from the first location on the frame to a second location on the frame using a third actuator so that the first bag covers an object. The plurality of fold grippers are opened after moving the arm support frame to the second location on the frame. The arm support frame is moved from the second location on the frame to the first location on the frame. The at least one of the plurality of fold grippers is moved from the second location on the arm support frame to the first location on the arm support frame. A plurality of bag grippers mounted to the arm support frame are closed on the first bag using a fourth actuator. The plurality of fold grippers are closed on the plurality of folds of a second bag attached to the first bag using the first actuator. The at least one of the plurality of fold grippers is moved using the second actuator from the first location on the arm support frame to the second location on the arm support frame thereby separating the first bag from the second bag and opening the second bag.

In another exemplary embodiment, a computer-readable medium is provided comprising computer-readable instructions that, upon execution by a processor, cause the processor to perform the operations of the method of automatically placing a bag over an object and removing the bag from a bag dispenser.

Other principal features and advantages of the invention will become apparent to those skilled in the art upon review of the following drawings, the detailed description, and the appended claims.

BRIEF DESCRIPTION OF THE DRAWINGS

Exemplary embodiments of the invention will hereafter be described with reference to the accompanying drawings, wherein like numerals denote like elements.

DETAILED DESCRIPTION

Figure 1:
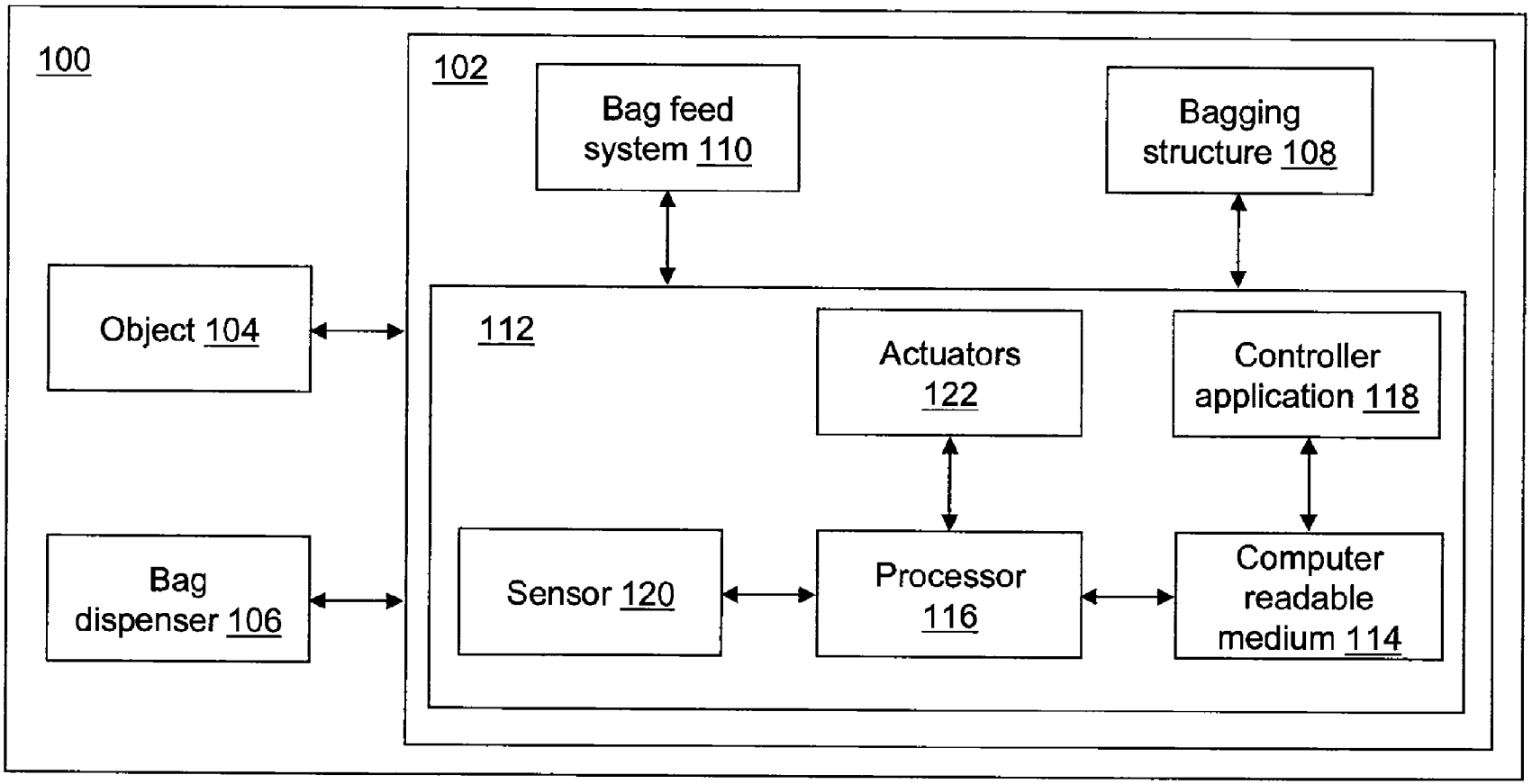
FIG. 1 depicts a block diagram of an automated bagging system in accordance with an exemplary embodiment.

With reference to FIG. 1, a block diagram of a bagging system 100 is shown in accordance with an exemplary embodiment. Bagging system 100 may include a bagging device 102, an object 104, and a bag dispenser 106. Bagging device 102 positions a bag extracted from bag dispenser 106 over object 104 to protect object 104 and any materials associated with object 104 from contaminants. In an exemplary embodiment, object 104 is a linen cart though other types of objects of varying sizes and shapes may also be used. Bag dispenser 106 includes a plurality of bags 220 (shown with reference to FIGS. 2, 6, and 7). In an exemplary embodiment, the bags are plastic bags though bags formed of other materials may also be used. In general, the bags are sized and shaped based on the size and shape of object 104.

Figure 2:
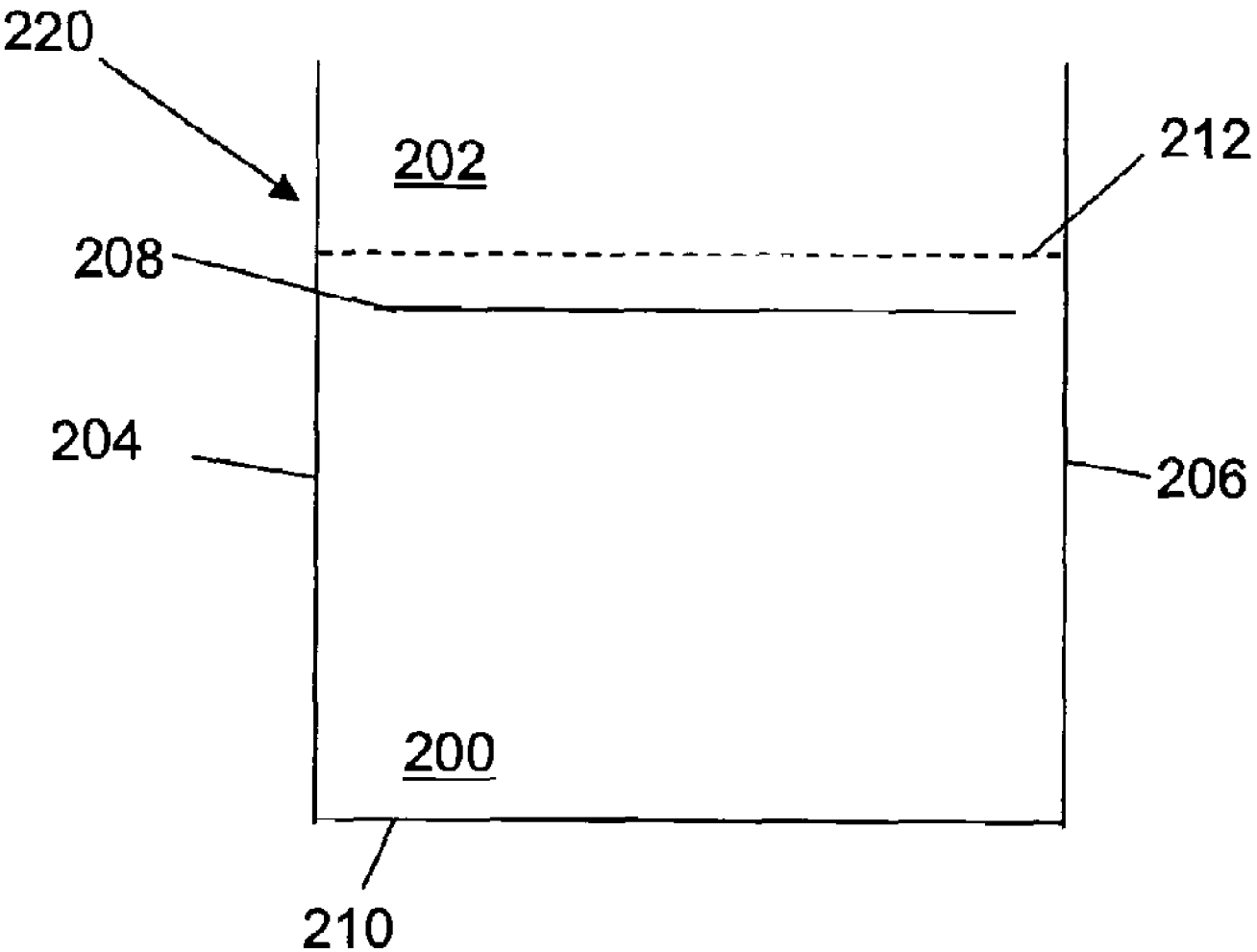
FIG. 2 depicts a bag usable in the automated bagging system of FIG. 1 in accordance with an exemplary embodiment.

With reference to FIG. 2, the plurality of bags 220 form a continuous sheet separated by perforations which delineate each bag. For example, a first bag 200 of the plurality of bags 220 is shown connected to a second bag 202. First bag 200 may include a first edge 204, a second edge 206 opposite first edge 204, a seal 208, a third edge 210, and a perforated edge 212. Each bag of the plurality of bags 220 can be laid flat and in a closed position defining first edge 204 and second edge 206. Each bag is sealed along seam 208 which does not extend the full distance between first edge 204 and second edge 206, but is generally perpendicular to first edge 204 and second edge 206. Third edge 210 extends between first edge 204 and second edge 206 and is generally parallel to seam 208. Perforated edge 212 extends between first edge 204 and second edge 206 and is generally parallel to seam 208. Perforated edge 212 and third edge 210 are positioned on opposite sides of seam 208.

Each bag can be opened along third edge 210. First bag 200 is separated from second bag 202 along perforated edge 212. Perforated edge 212 defines the third edge of second bag 202 after separation of first bag 200 from second bag 202. In an exemplary embodiment, first bag 200 opens 64 inches between first edge 204 and second edge 206, 79 inches between third edge 210 and perforated edge 212, and 32 inches in a direction perpendicular to first edge 204 and to third edge 210. In an exemplary embodiment, perforated edge 212 stop two inches from first edge 204 and from second edge 206. Additional bags of the plurality of bags 220 are formed and connected in a similar manner. In an exemplary embodiment, bag dispenser 106 is a roller about which the plurality of bags 220 is wound. Other bag dispensing mechanisms may be used without limitation.

Figure 3:
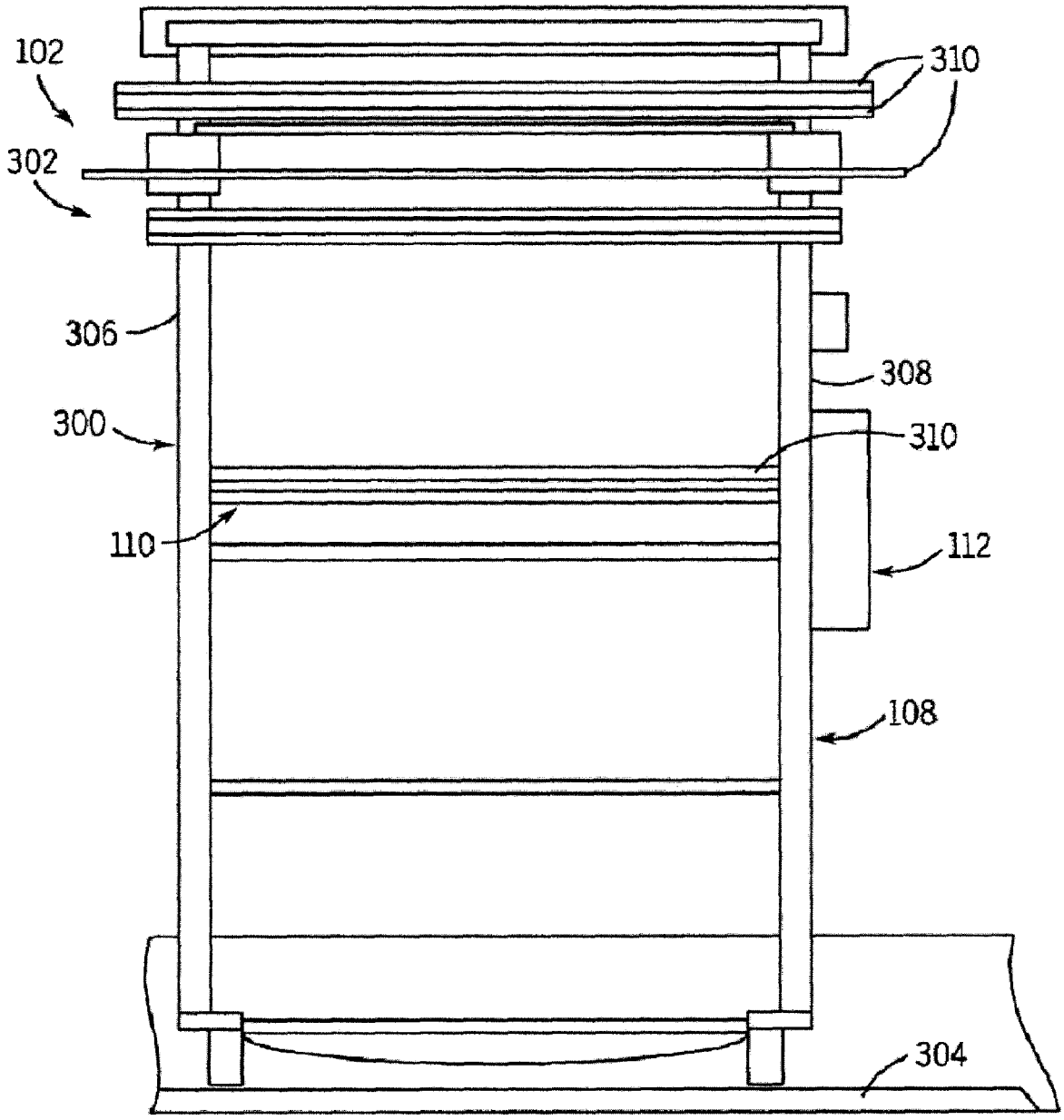
FIG. 3 shows a first front view of a bagging mechanism usable in the automated bagging system of FIG. 1 in accordance with an exemplary embodiment.

With continuing reference to FIG. 1, bagging device 102 may include a bagging structure 108, a bag feed system 110, and a controller 112. With reference to FIG. 3, bagging device 102 is shown in accordance with an exemplary embodiment. Bagging structure 108 may include a frame 300, an arm support frame 302, and an object positioning guide 304. Frame 300 may include a plurality of legs mounted to each other to provide a stable platform for arm support frame 302 and bag feed system 110. As used herein, the term "mount" includes join, unite, connect, associate, insert, hang, hold, affix, attach, fasten, bind, paste, secure, bolt, screw, rivet, solder, weld, and other like terms. Frame 300 may have a variety of shapes and sizes dependent on object 104. Arm support frame 302 is mounted between a first leg 306 of the plurality of legs and a second leg 308 of the plurality of legs to move in a vertical direction under control of controller 112. With reference to FIG. 3, arm support frame 302 is shown in a first position. Object positioning guide 304 positions object 104 correctly with respect to bagging device 102. In the exemplary embodiment of FIG. 3, object positioning guide 304 is a locking rail extending from frame 300 and through which a support of object 104 can be moved. For example, a wheel of a linen cart can be manually or automatically rolled through object positioning guide 304 which may lock the wheel in place at the appropriate position manually or under control of controller 112.

Bag feed system 110 includes a plurality of rollers 310 which control the position of the plurality of bags 220 and the tension on the plurality of bags 220. A fewer or a greater number of rollers may be used. In an exemplary embodiment, bag dispenser 106 mounts to frame 300. The plurality of bags 220 of bag dispenser 106 are fed through bag feed system 110 and positioned adjacent object 104. One or more of the plurality of rollers 310 may be driven rollers. In an exemplary embodiment, the plurality of rollers 310 are idler rollers and the movement of the plurality of bags is controlled through movement of arm support frame 302 as discussed below.

With continuing reference to FIG. 1, controller 112 may include a computer-readable medium 114, a processor 116, a controller application 118, a sensor 120, and actuators 122. Different and additional components may be incorporated into controller 112. For example, controller 112 may further include an input interface, an output interface, a communication interface, etc. The input interface may provide an interface for receiving information from the user for entry into controller 112 as known to those skilled in the art. The input interface may use various input technologies including, but not limited to, a keyboard, a pen and touch screen, a mouse, a track ball, a touch screen, a keypad, one or more buttons, etc. to allow the user to enter information into controller 112. The output interface may provide an interface for presenting information from controller 112 to the user as known to those skilled in the art. For example, a display presents output to the user such as a system status message. Components of bagging system 100 may be positioned in a single location or may be remote from one another. For example, components of controller 112 may be located remote from bagging structure 108. As a result, controller 112 may also include a communication interface, which provides an interface for receiving and transmitting data between devices using various protocols, transmission technologies, and media as known to those skilled in the art. The communication interface may support communication using various transmission media that may be wired or wireless. Thus, the components of controller 112 may be connected as appropriate using wires or other coupling methods or wirelessly and may be positioned at various locations on bagging structure 108 or remote from bagging structure 108.

Computer-readable medium 114 is an electronic holding place or storage for information so that the information can be accessed by processor 116 as known to those skilled in the art. Computer-readable medium 114 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., compact disk (CD), digital versatile disk (DVD), . . . ), smart cards, flash memory devices, etc. Controller 112 may have one or more computer-readable media that use the same or a different memory media technology. Controller 112 also may have one or more drives that support the loading of a memory media such as a CD, a DVD, a flash memory card, etc.

Processor 116 executes instructions as known to those skilled in the art. The instructions may be carried out by a special purpose computer, logic circuits, or hardware circuits. Thus, processor 116 may be implemented in hardware, firmware, software, or any combination of these methods. The term "execution" is the process of running an application or the carrying out of the operation called for by an instruction. The instructions may be written using one or more programming language, scripting language, assembly language, etc. Processor 116 executes an instruction, meaning that it performs the operations called for by that instruction. Processor 116 operably couples with computer-readable medium 114, controller application 118, sensor 120, actuators 122, etc. to receive, to send, and to process information and to control the operations of bagging device 102. Processor 116 may retrieve a set of instructions from a permanent memory device such as a ROM device and copy the instructions in an executable form to a temporary memory device that is generally some form of RAM. Controller 112 may include a plurality of processors that use the same or a different processing technology.

Controller application 118 includes operations which control bagging device 102. The operations may be implemented using hardware, firmware, software, or any combination of these methods. With reference to the exemplary embodiment of FIG. 1, controller application 118 is implemented in software stored in computer-readable medium 114 and accessible by processor 116 for execution of the computer-readable instructions that embody the operations of controller application 118. The computer-readable instructions of controller application 118 may be written using one or more programming languages, assembly languages, scripting languages, etc. Some or all of the operations described with reference to FIG. 4 may be performed through execution of the computer-readable instructions of controller application 118 based on inputs received from and/or commands sent to actuators 122 and/or sensor 120.

Sensor 120 may be mounted to frame 300 to signal occurrence of an event. In an exemplary embodiment, sensor 120 is an infrared sensor mounted to frame 300 such that bag feed system 110 feeds the plurality of bags 220 between a transmitter and a receiver of sensor 120 to detect passage of perforated edge 212. Sensor 120 provides a signal to processor 116 indicating passage of seam 208.

Actuators 122 control movement of one or more component of bagging device 102. Exemplary actuators include an electric motor, a servo, stepper, or piezo motor, a pneumatic actuator, a gas motor, or the like. In an exemplary embodiment, actuators 122 comprise air cylinders having magnets that activate switches under control of processor 116.

Figure 4:
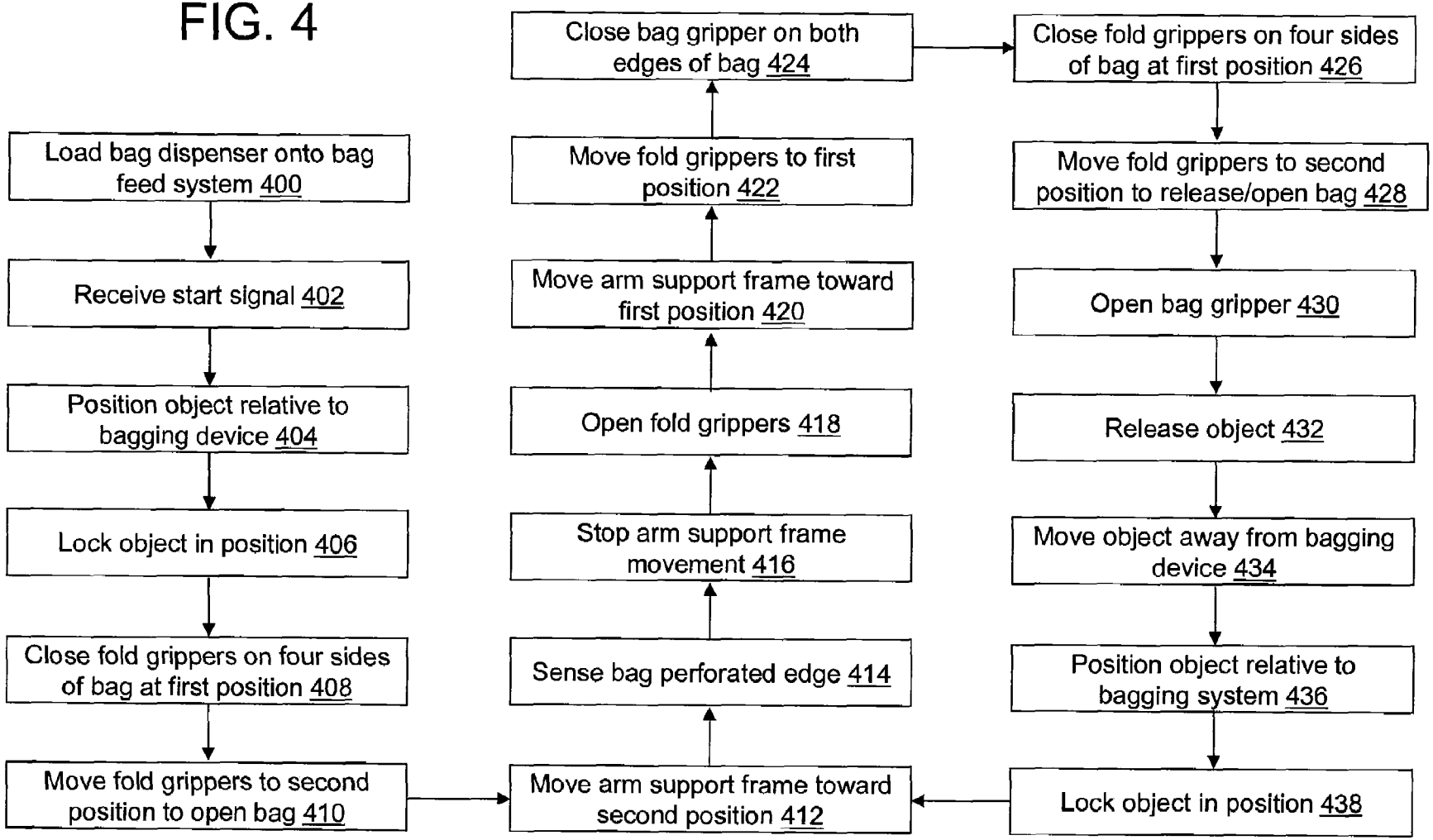
FIG. 4 depicts a flow diagram illustrating exemplary operations performed by the automated bagging system of FIG. 1 in accordance with an exemplary embodiment.
Figure 5:
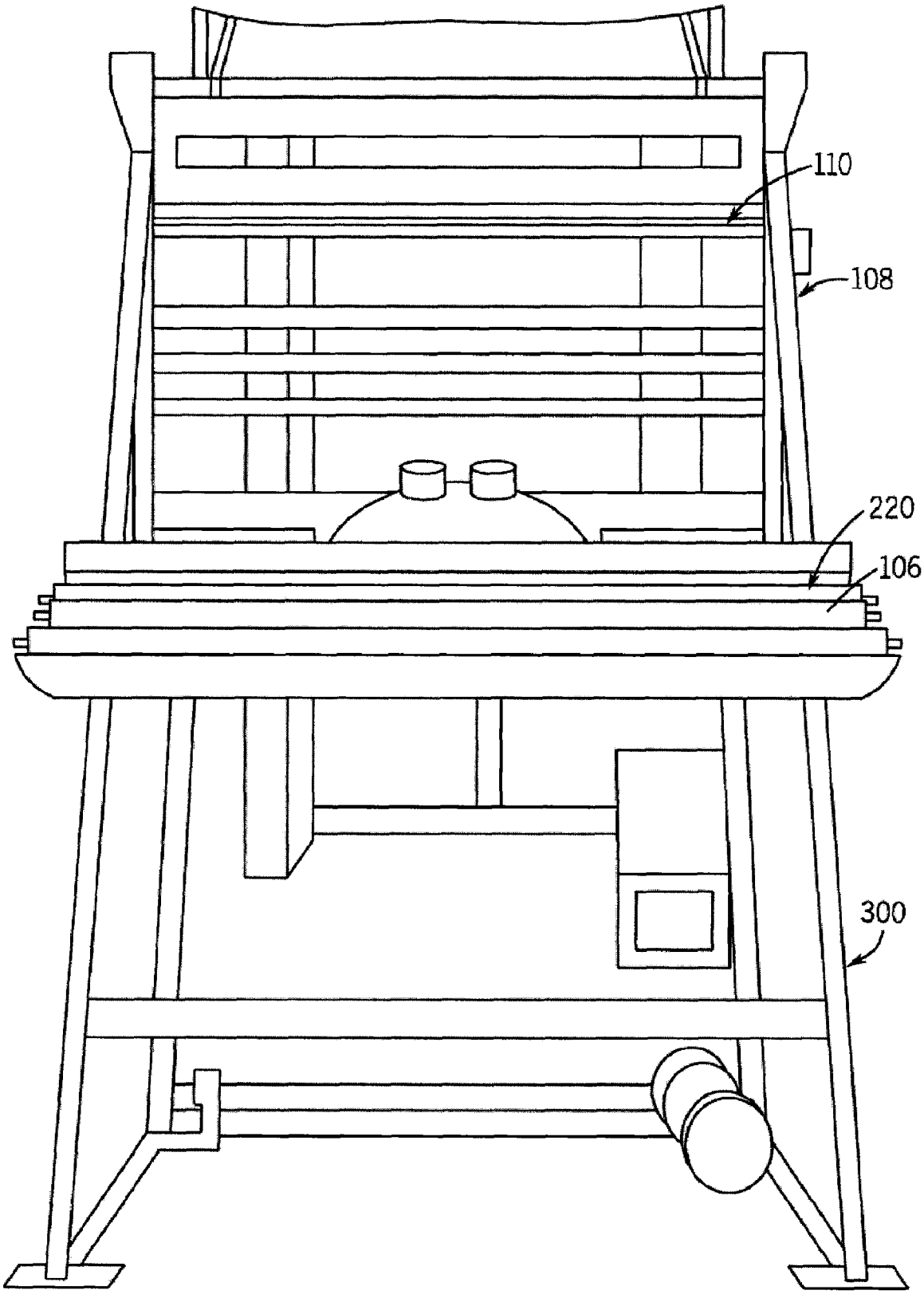
FIG. 5 shows a rear view of the bagging mechanism of FIG. 3 in accordance with an exemplary embodiment.
Figure 6:
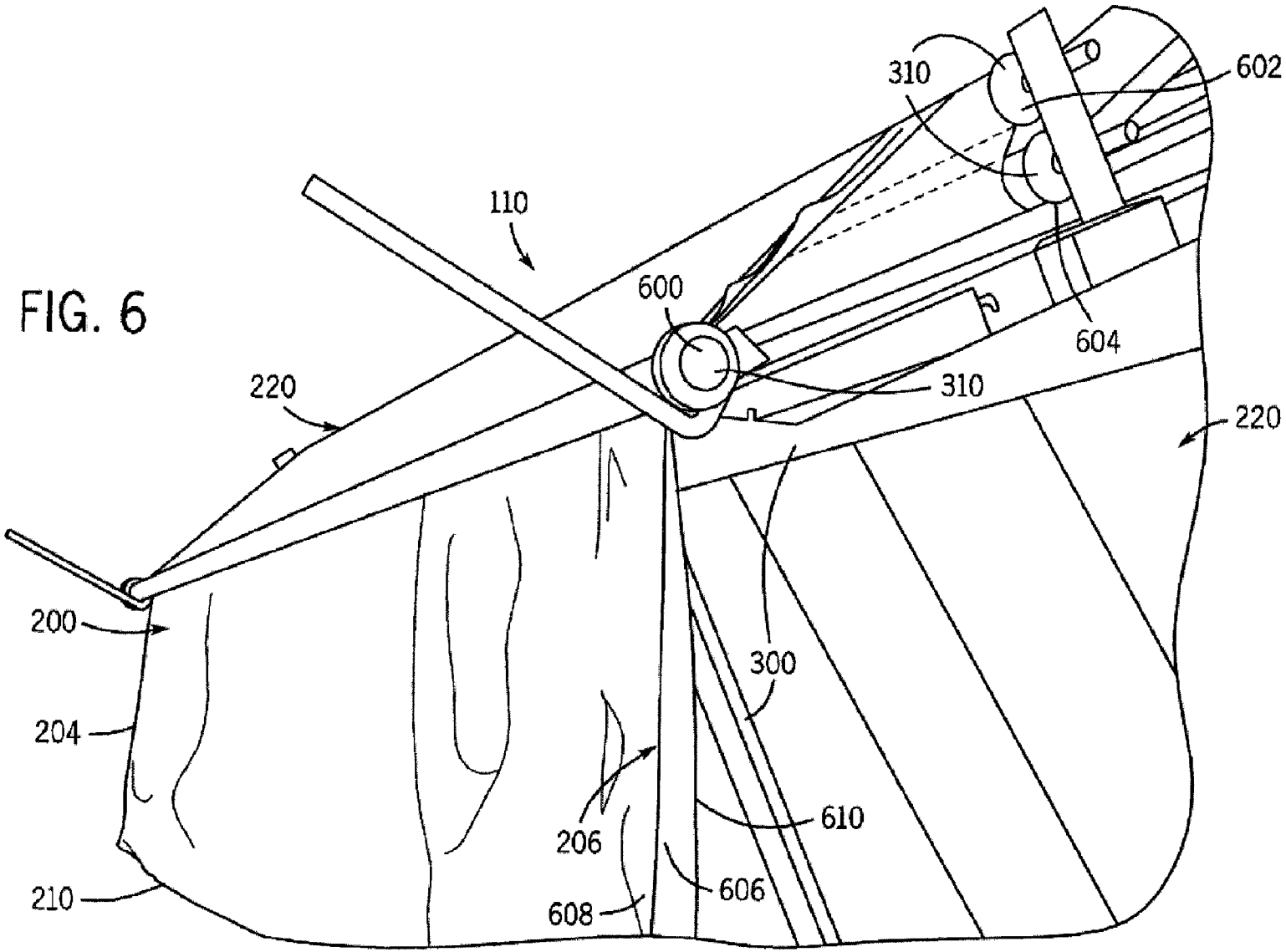
FIG. 6 shows a first side perspective view of a bag feed system of the bagging mechanism of FIG. 3 in accordance with an exemplary embodiment.

With reference to FIG. 4, exemplary operations associated with controller application 118 of FIG. 1 are described. Additional, fewer, or different operations may be performed, depending on the embodiment. The order of presentation of the operations is not intended to be limiting. In an operation 400, bag dispenser 106 is loaded onto bag feed system 110. For example, with reference to FIGS. 5-7, bag dispenser 106 in the form of a bag roll is loaded onto frame 300 of bagging structure 108. In the exemplary embodiment of FIG. 5, bag dispenser 106 is mounted to a back side of bagging structure 108 opposite the front side of bagging structure 108 shown with reference to FIG. 3. The plurality of bags 220 are wound around the plurality of rollers 310 to extend from the front side of bagging structure 108 shown with reference to FIG. 6. With reference to FIG. 6, the plurality of rollers 310 include a first roller 600, a second roller 602, and a third roller 604. First bag 200 extends freely from first roller 600. In the exemplary embodiment of FIG. 6, second roller 602 and third roller 604 are arranged as two parallel rollers pressed together and between which the plurality of bags passes before extending freely from first roller 600. As shown in FIG. 6, second edge 206 of first bag 200 includes a fold 606 between a first fold edge 608 and a second fold edge 610. First edge 204 includes a corresponding fold (not shown) and fold edges thus defining four fold edges.

Figure 7:
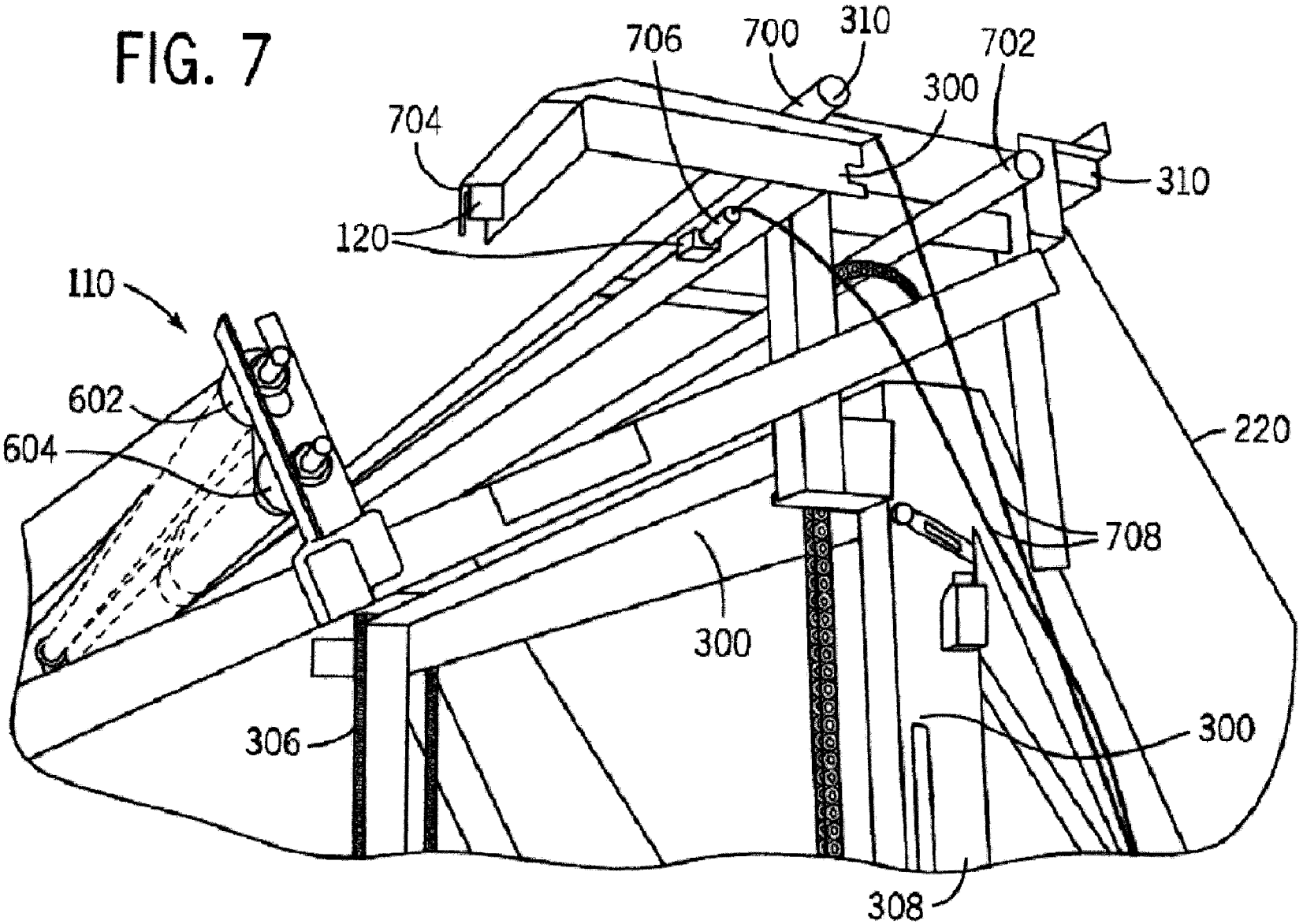
FIG. 7 shows a second side perspective view of the bag feed system of the bagging mechanism of FIG. 3 in accordance with an exemplary embodiment.

With reference to FIG. 7, the plurality of rollers 310 further include a fourth roller 700 and a fifth roller 702 which guide the plurality of bags 220 over the top of bagging structure 108 from the back side to the front side. Sensor 120 includes a transmitter 704 and a receiver 706 mounted to frame 300 on either side of the plurality of bags 220 as the plurality of bags 220 are fed between fourth roller 700 and third roller 604. As known to a person of skill in the art, transmitter 704 and receiver 706 can be reversed and can be mounted at other locations relative to bag feed system 110. Wires 708 connect transmitter 704 and receiver 706 of sensor 120 to processor 116.

With continuing reference to FIG. 4, in an operation 402, a start signal is received. For example, a start button or a power on button may be pushed or selected by a user sending the start signal to processor 116. In an operation 404, object 104 is positioned relative to bagging device 102. For example, a linen cart may be manually or automatically positioned relative to bagging structure 108 using object positioning guide 304. In an operation 406, object 104 may be locked into position relative to bagging structure 108 manually or automatically to avoid movement of object 104 while the bag is positioned over object 104. A variety of locking mechanisms may be used as known to those skilled in the art.

Figure 8:
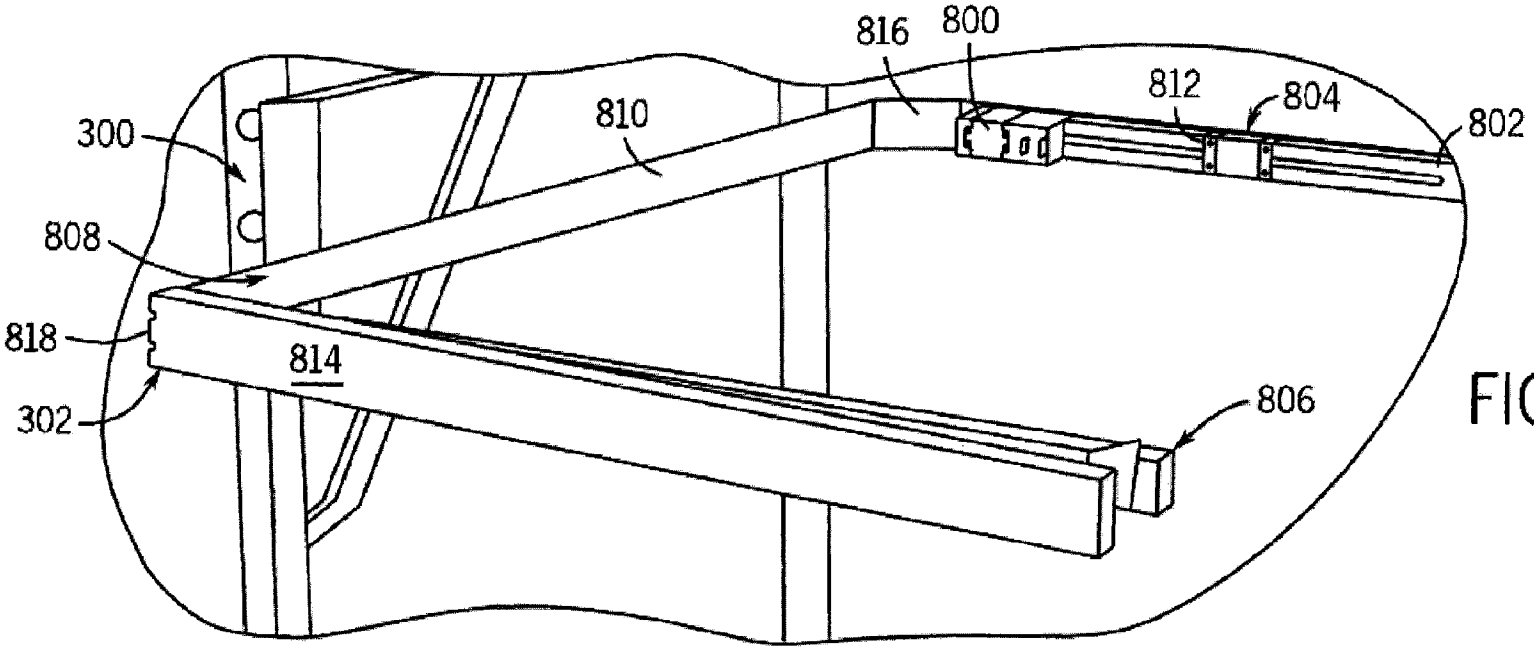
FIG. 8 shows a side perspective view of an arm support frame of the bagging mechanism of FIG. 3 in accordance with an exemplary embodiment.
Figure 9:
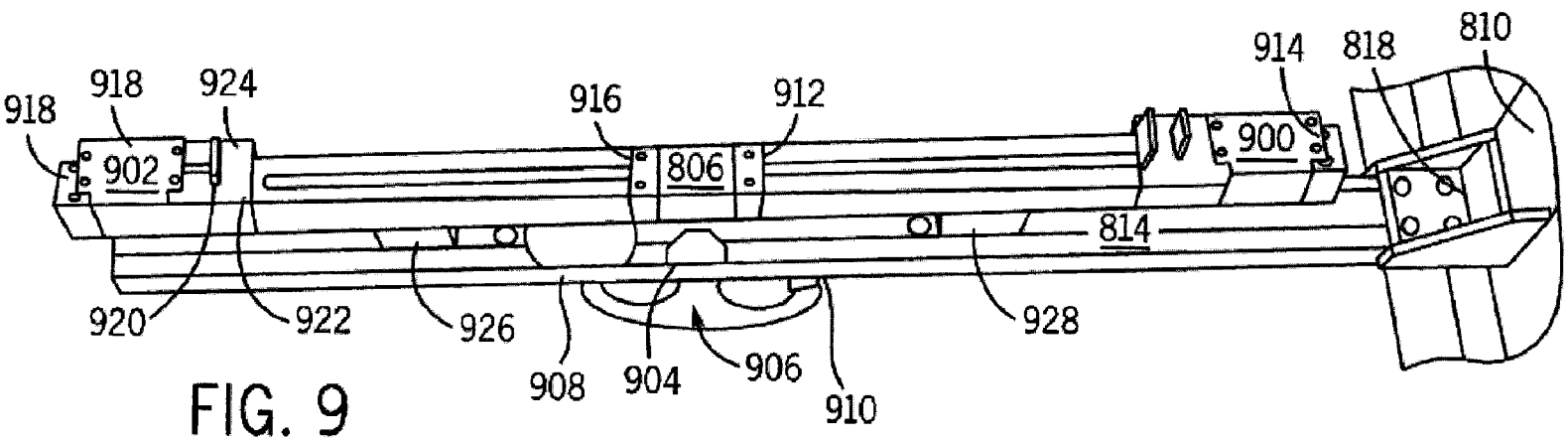
FIG. 9 shows a front perspective view of an arm of the arm support frame of the bagging mechanism of FIG. 3 in accordance with an exemplary embodiment.

With reference to FIGS. 8 and 9, arm support frame 302 includes a first fold gripper 800, a second fold gripper 802, a third fold gripper 900, and a fourth fold gripper 902. Arm support frame 302 further includes a first arm 804, a second arm 806, and a support frame 808. Support frame 808 mounts to frame 300 and includes a support arm 810, a first extension arm 812, and a second extension arm 814. First extension arm 812 extends in a generally perpendicular direction from a first end 816 of support arm 810. Second extension arm 814 extends in a generally perpendicular direction from a second end 818 of support arm 810. First extension arm 812 and second extension arm 814 extend from support arm 810 in the same direction, but from opposite ends of support arm 810.

First arm 804 is mounted to first extension arm 812 using a first brace (not shown) and a second brace (not shown) which extend from first extension arm 812 in a generally perpendicular direction. First arm 804 is generally parallel to first extension arm 812. Second arm 806 is mounted to second extension arm 814 using a first brace 926 and a second brace 928 which extend from second extension arm 814 in a generally perpendicular direction. Second arm 806 is generally parallel to second extension arm 814. First arm 804 and second arm 806 are mounted to face each other. In the exemplary embodiment of FIGS. 8 and 9, first arm 804 and second arm 806 are movably mounted to first extension arm 812 and to second extension arm 814, respectively, to move towards and away from each other under control of an actuator of actuators 122.

First fold gripper 800 and second fold gripper 802 are slidably mounted to first arm 804 to move between two positions. Third fold gripper 900 and fourth fold gripper 902 are slidably mounted to second arm 806 to move between two positions. Second arm 806 and second extension arm 814 are shown in greater detail with reference to FIG. 9. First arm 804 and second arm 806 and first extension arm 812 and second extension arm 814 have a similar structure. Therefore, first arm 804 first extension arm 812 are not described in greater detail, but are understood to include similar elements to those described with reference to second arm 806 and second extension arm 814, respectively.

Third fold gripper 900 is mounted to slide from a first gripper position 912 to a second gripper position 914, and fourth fold gripper 902 is mounted to slide from a third gripper position 916 to a fourth gripper position 918. With reference to FIG. 9, third fold gripper 900 is positioned at second gripper position 914 and fourth fold gripper 902 is positioned at fourth gripper position 918. Second arm 806 further includes a fold guide 904 and a bag gripper 906. Fold guide 904 is mounted to second arm 806 near a center of second arm 806 between first gripper position 912 and third gripper position 916 and below first gripper position 912 and third gripper position 916. Bag gripper 906 is mounted to second arm 806 near a center of second arm 806 between first gripper position 912 and third gripper position 916 and below fold guide 904. Bag gripper 906 includes a first finger 908 and a second finger 910 which can be controlled to move toward or away from each other to open and close about an object. First arm 804 further includes a fold guide and a bag gripper mounted in a similar manner to first arm 804.

With reference to FIG. 9, third fold gripper 900 and fourth fold gripper 902 are shown in an open position at second gripper position 914 and at fourth gripper position 918, respectively. Fourth fold gripper 902 includes an actuator (not shown) of actuators 122, an actuator housing 918, a movable stop 920, a stop 922, and a stop support 924. Actuator housing 918 encloses the actuator. Movable stop 920 is movably mounted to actuator housing 918 and can be moved toward or away from stop 922 under control of the actuator which is under control of processor 116 executing controller application 118. Stop support 924 mounts to and extends from actuator housing 918 so that the actuator, actuator housing 918, movable stop 920, stop 922, and stop support 924 move as a unit along one side of second arm 806. Stop 922 extends in a generally perpendicular direction from stop support 924. Movable stop 920 moves toward stop 922 gripping an object positioned between movable stop 920 and stop 922. First fold gripper 800, second fold gripper 802, and third fold gripper 900 have a similar structure to fourth fold gripper 902. Therefore, first fold gripper 800, second fold gripper 802, and third fold gripper 900 are not described in greater detail, but are understood to include similar elements to those described with reference to fourth fold gripper 902.

Figure 10:
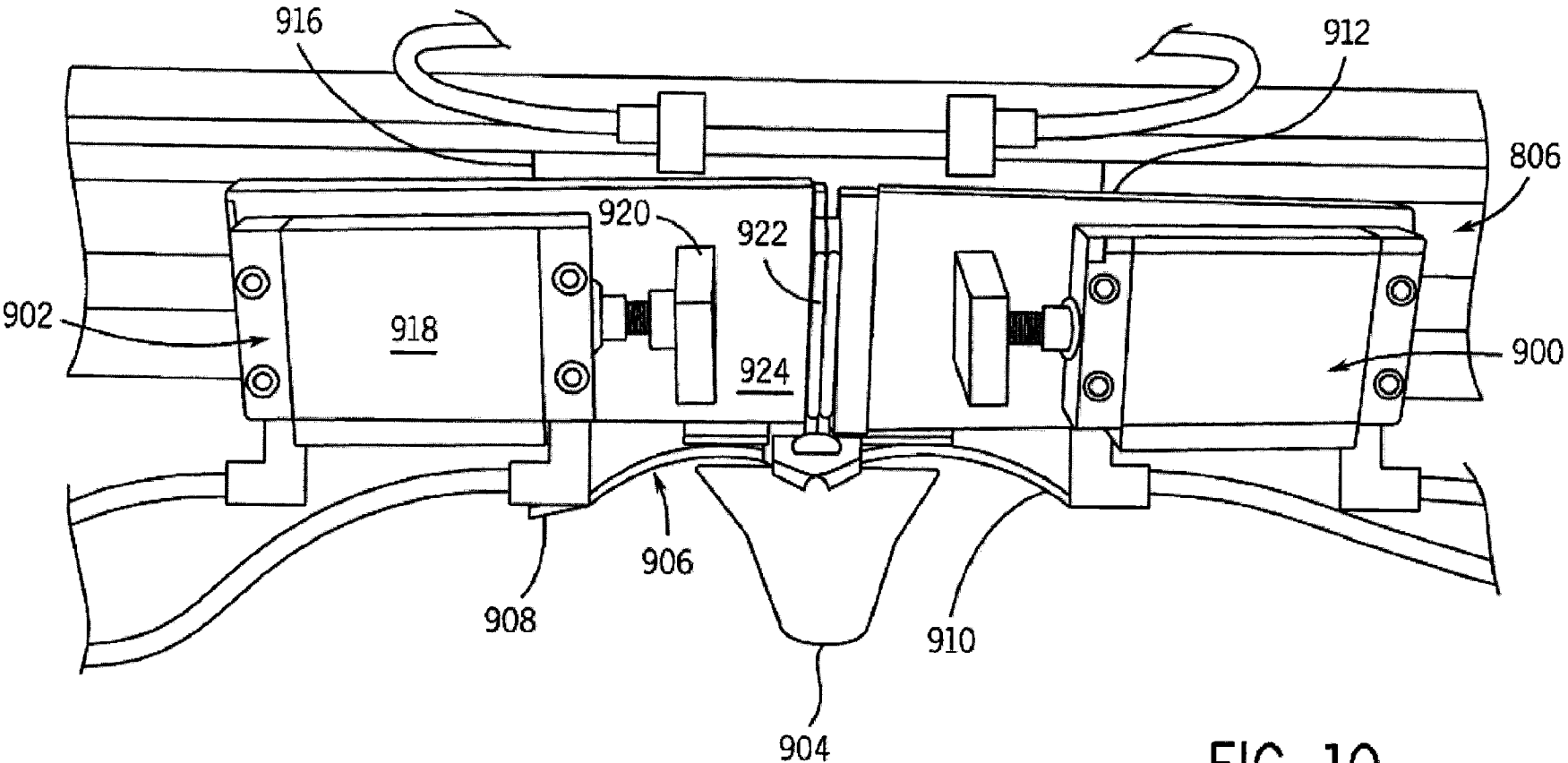
FIG. 10 shows a front perspective detailed view of the arm of FIG. 9 with a bag gripper and fold grippers in open positions in accordance with an exemplary embodiment.
Figure 11:
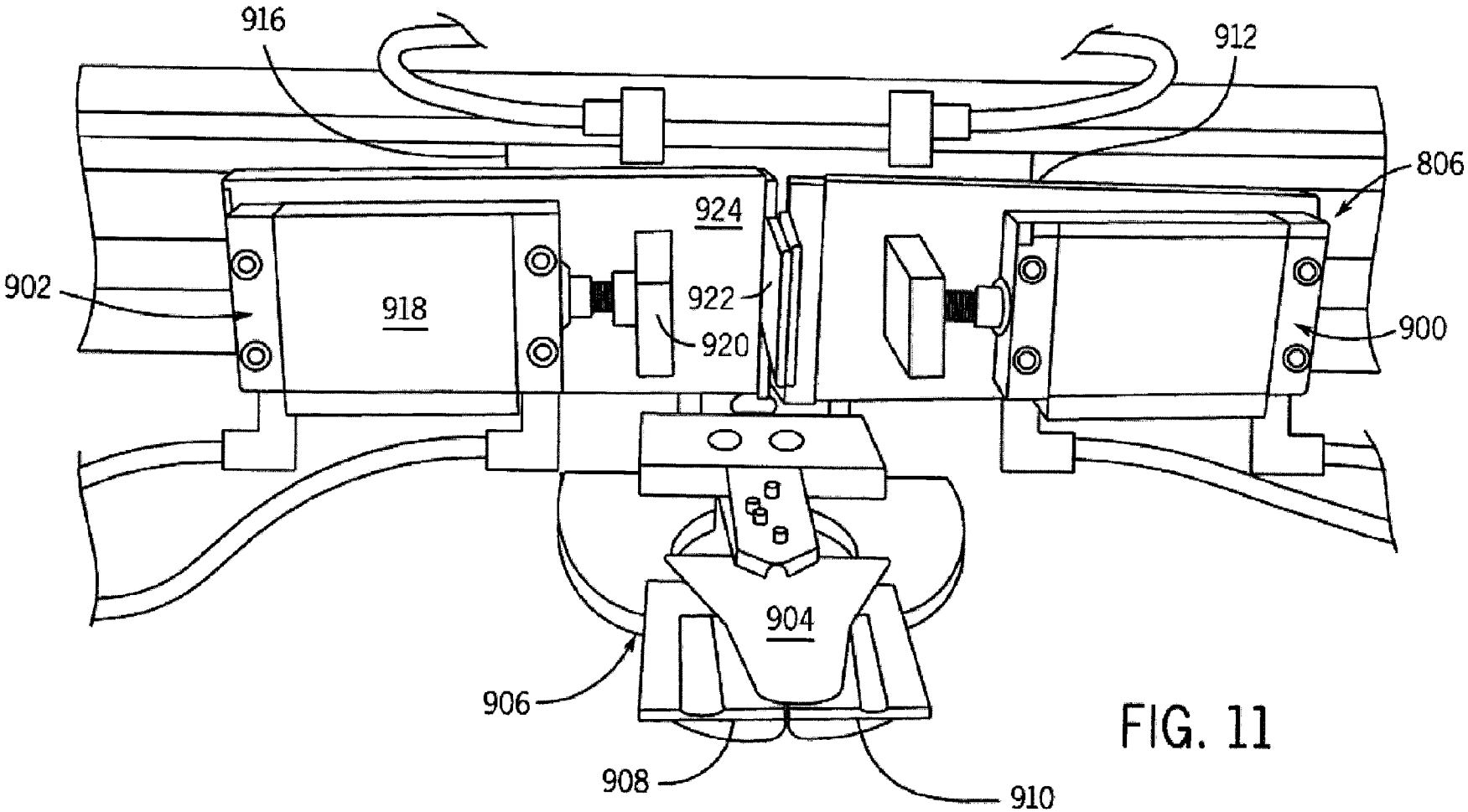
FIG. 11 shows a front perspective detailed view of the arm of FIG. 9 with the fold grippers in open positions and the bag gripper of FIG. 10 in a closed position in accordance with an exemplary embodiment.
Figure 12:
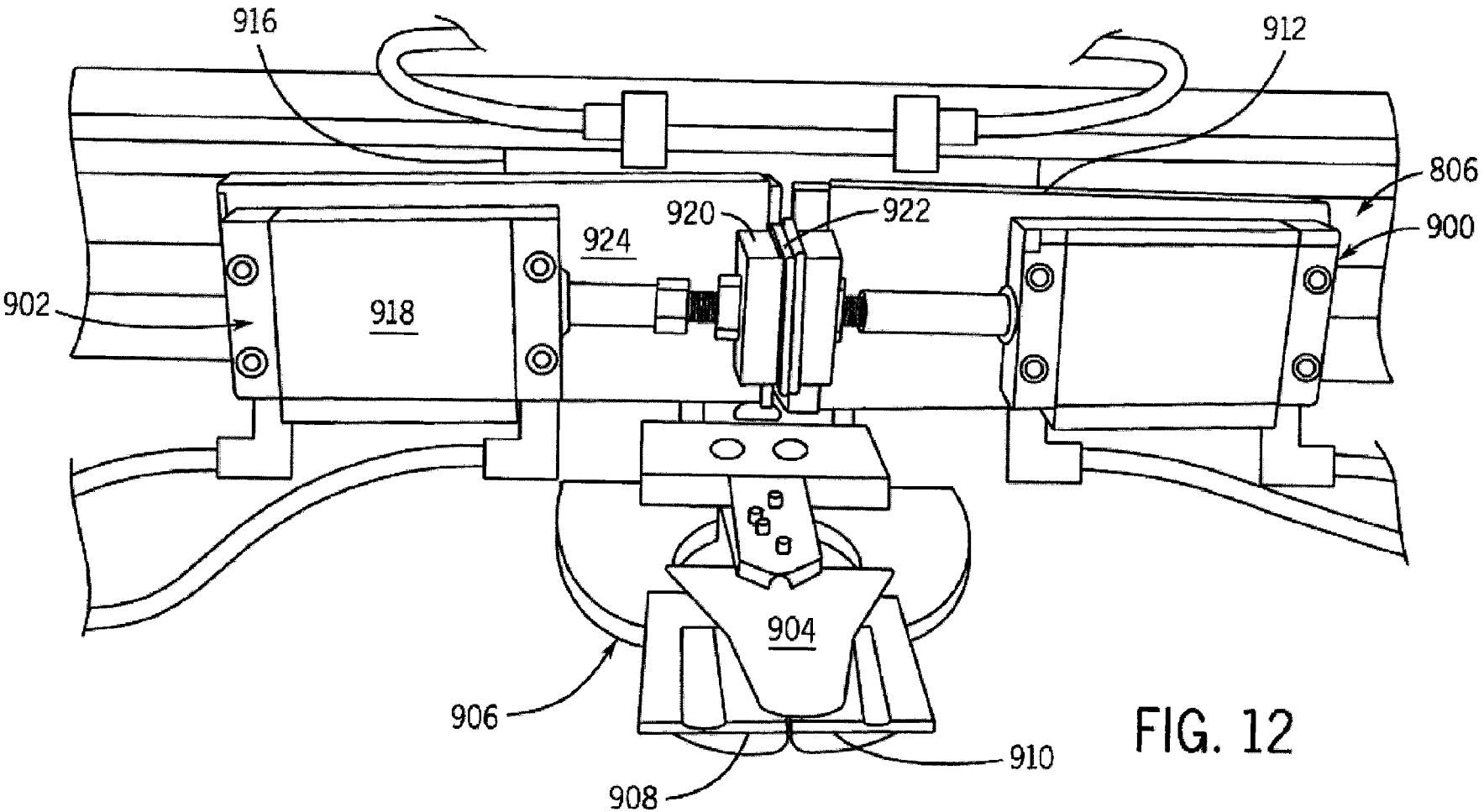
FIG. 12 shows a front perspective detailed view of the arm of FIG. 9 with the bag gripper and the fold grippers in closed positions in accordance with an exemplary embodiment.

With reference to FIG. 10, third fold gripper 900 and fourth fold gripper 902 are shown in an open position at first gripper position 912 and at third gripper position 916, respectively. Additionally, bag gripper 906 is shown in an open position with first finger 908 separated from second finger 910. With reference to FIG. 11, bag gripper 906 is shown in a closed position with first finger 908 pressed against second finger 910. With reference to FIG. 12, fourth fold gripper 902 is shown in a closed position with movable stop 920 pressed against stop 922.

With continuing reference to FIG. 4, in an operation 408, first fold gripper 800 is closed on first fold edge 608 of second edge 206, second fold gripper 802 is closed on second fold edge 610 of second edge 206, third fold gripper 900 is closed on the third fold edge of first edge 204, and fourth fold gripper 902 is closed on the fourth fold edge of first edge 204. Arm support frame 302 is located at the first position shown with reference to FIG. 3 and first bag 200 is located as generally shown in FIG. 6 with third edge 210 extending approximately two inches below first roller 600. Third fold gripper 900 is located at first gripper position 912 and fourth fold gripper 902 is located at third gripper position 916 as shown with reference to FIG. 12. First fold gripper 800 and second fold gripper 802 are similarly located on first arm 804.

Figure 13:
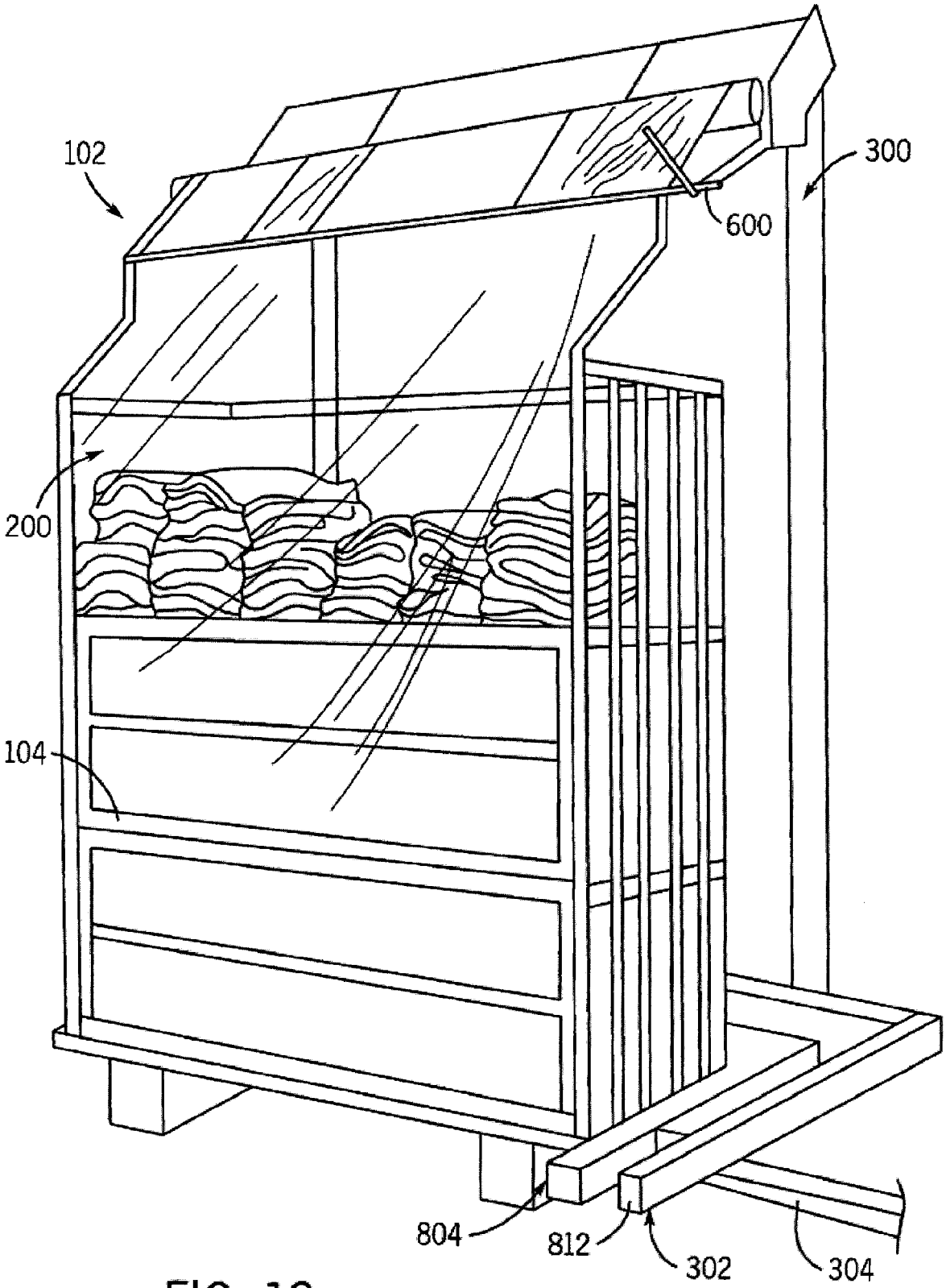
FIG. 13 shows a second front view of the bagging mechanism of FIG. 3 with the arm support of FIG. 8 in a second position in accordance with an exemplary embodiment.

In an operation 410, third fold gripper 900 is moved along second arm 806 to second gripper position 914, and fourth fold gripper 902 is moved along second arm 806 to fourth gripper position 918. First fold gripper 800 and second fold gripper 802 are similarly moved on first arm 804. Movement of the fold grippers 800, 802, 900, 902 in this manner has the effect of opening first bag 200. A further movement of first arm 804 and of second arm 806 away from each other under control of actuators also may be employed to further open first bag 200. In an operation 412, arm support frame 302 is moved to a second position shown with reference to FIG. 13 thereby covering object 104 with first bag 200. As arm support frame 302 is moved downward to the second position, the plurality of bags is pulled between transmitter 704 and receiver 706 of sensor 120 which senses the passage of seam 208 of first bag 200. Sensor 120 sends a signal to processor 116 indicating passage of seam 208 of first bag 200. Processor 116 receives the signal. In an operation 416, vertical movement of arm support frame 302 is stopped based on receipt of the signal from sensor 120.

In an operation 418, the fold grippers 800, 802, 900, 902 are opened releasing first bag 200. In an operation 420, arm support frame 302 is moved vertically upward to the first position shown with reference to FIG. 3. In an operation 422, third fold gripper 900 is moved along second arm 806 from second gripper position 914 to first gripper position 912, and fourth fold gripper 902 is moved along second arm 806 from fourth gripper position 918 to third gripper position 916. First fold gripper 800 and second fold gripper 802 are similarly moved on first arm 804. As arm support frame 302 is moved upward from the second position to the first position, the fold guide of first arm 804 is moved along fold 606 of second edge 206 of first bag 200 and fold guide 904 of second arm 806 is moved along the corresponding fold of first edge 204 of first bag 200. The fold guides separate the fold edges of first edge 204 and first fold edge 608 and second fold edge 610 of second edge 206 allowing the fold edges of first bag 200 to slide between movable stop 920 and stop 922. A further movement of first arm 804 and of second arm 806 toward each other also may be employed to position the fold edges between movable stop 920 and stop 922 of the fold grippers 800, 802, 900, 902.

In an operation 424, the bag gripper of first arm 804 and bag gripper 906 of second arm 806 are closed on first edge 204 and on second edge 206, respectively, of first bag 200. In an operation 426, the fold grippers 800, 802, 900, 902 are closed on the fold edges of second bag 202 above perforated edge 212 of first bag 200. Thus, the bag grippers hold first bag 200 between first finger 908 and second finger 910 of the bag grippers, and the fold grippers 800, 802, 900, 902 hold second bag 202 between movable stop 920 and stop 922 of the fold grippers 800, 802, 900, 902. In an operation 428, third fold gripper 900 is moved along second arm 806 to second gripper position 914, and fourth fold gripper 902 is moved along second arm 806 to fourth gripper position 918. First fold gripper 800 and second fold gripper 802 are similarly moved on first arm 804. Movement of the fold grippers 800, 802, 900, 902 in this manner has the effect of removing first bag 200 from second bag 202 along perforated edge 212 and of opening second bag 202. A further movement of first arm 804 and of second arm 806 away from each other also may be employed to further release first bag 200 from second bag 202 and to further open second bag 202.

In an operation 430, the bag gripper of first arm 804 and bag gripper 906 of second arm 806 are opened releasing first bag 200. In an operation 432, object 104 is released. In an operation 434, object 104 is moved away from bagging device 102. In an operation 436, a second object 104 is positioned relative to bagging device 102. In an operation 438, the second object 104 may be locked into position relative to bagging structure 108 manually or automatically. Processing continues at operation 412 to initiate bagging of the second object 104.

As stated previously, the order of presentation of the operations described with reference to FIG. 4 are not intended to be limiting. For example, in an alternative embodiment, after operation 400, operations 408, 410, 404, and 406 may be performed in that order before operation 402. After completion of operations 412-438, a start signal may be received before processing continues at operation 412 to initiate bagging of the second object 104. In this alternative embodiment, object 102 may be manually positioned by a user and the user may select a start button before each object 104 is processed.

Bagging device 102 has been described with reference to a generally rectangular object. If object 104 has a different shape, a fewer or a greater number of fold grippers may be used to open first bag 200 to correspond generally to a shape of object 104. For example, if object 104 has a triangular shape, three fold grippers may be used instead of the described four fold grippers to create the three corners that define the shape of a triangular object 104 instead of the four corners of a rectangular object 104.

The word "exemplary" is used herein to mean serving as an example, instance, or illustration. Any aspect or design described herein as "exemplary" is not necessarily to be construed as preferred or advantageous over other aspects or designs. Further, for the purposes of this disclosure and unless otherwise specified, "a" or "an" means "one or more". The exemplary embodiments may be implemented as a method, machine, or article of manufacture using standard programming and/or engineering techniques to produce software, firmware, hardware, or any combination thereof to control a computer to implement the disclosed embodiments.

The foregoing description of exemplary embodiments of the invention have been presented for purposes of illustration and of description. It is not intended to be exhaustive or to limit the invention to the precise form disclosed, and modifications and variations are possible in light of the above teachings or may be acquired from practice of the invention. The functionality described may be implemented in a single executable or application or may be distributed among modules that differ in number and distribution of functionality from those described herein. Additionally, the order of execution of the functions may be changed depending on the embodiment. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A device comprising:

a frame;

an arm support frame, wherein the arm support frame is movably mounted to the frame;

a plurality of fold grippers mounted to the arm support frame, wherein at least one of the plurality of fold grippers is movably mounted to the arm support frame;

a plurality of bag grippers mounted to the arm support frame;

a first actuator configured to close the plurality of bag grippers;

a processor; and a computer-readable medium including computer-readable instructions stored therein that, upon execution by the processor, perform operations comprising closing the plurality of fold grippers on a plurality of folds of a first bag;

moving at least one of the plurality of fold grippers from a first location relative to the arm support frame to a second location relative to the arm support frame thereby opening the first bag;

moving the arm support frame from a first location on the frame to a second location on the frame so that the first bag covers an object;

opening the plurality of fold grippers after moving the arm support frame to the second location on the frame;

moving the arm support frame from the second location on the frame to the first location on the frame;

moving the at least one of the plurality of fold grippers from the second location relative to the arm support frame to the first location relative to the arm support frame;

causing the first actuator to close the plurality of bag grippers on the first bag;

closing the plurality of fold grippers on the plurality of folds of a second bag attached to the first bag; and moving the at least one of the plurality of fold grippers from the first location relative to the arm support frame to the second location relative to the arm support frame to separate the first bag from the second bag and open the second bag.

2. The device of claim 1, further comprising a second actuator configured to close the plurality of fold grippers.

3. The device of claim 1, further comprising a second actuator configured to move the at least one of the plurality of fold grippers.

4. The device of claim 1, further comprising a second actuator configured to move the arm support frame.

5. The device of claim 1, further comprising a sensor configured to sense a location of a seam, wherein the arm support frame is moved from the first location on the frame to the second location on the frame based on the sensed location of the seam.

6. The device of claim 1, further comprising a bag feed system mounted to the frame and configured to position the first bag relative to the arm support frame.

7. The device of claim 1, further comprising a fold guide mounted to the arm support frame and configured to separate the plurality of folds of the first bag.

8. The device of claim 7, wherein the fold guide is mounted between a fold gripper of the plurality of fold grippers and a bag gripper of the plurality of bag grippers.

9. The device of claim 1, wherein the arm support frame comprises a support frame, a first arm mounted to the support frame, and a second arm mounted to the support frame.

10. The device of claim 9, wherein at least a first fold gripper of the plurality of fold grippers is mounted to the first arm and wherein at least a second fold gripper of the plurality of fold grippers is mounted to the second arm.

11. The device of claim 10, wherein a first bag gripper of the plurality of bag grippers is mounted to the support frame and wherein a second bag gripper of the plurality of bag grippers is mounted to the support frame.

12. The device of claim 11, further comprising a first fold guide mounted to the support frame between the first bag gripper and the first fold gripper.

13. The device of claim 9, wherein the first arm and the second arm are movably mounted to the support frame to move toward each other.

14. A computer-readable medium including computer-readable instructions tangibly stored therein that, upon execution by a processor of an electronic device, cause the electronic device to:

close a plurality of fold grippers on a plurality of folds of a first bag, wherein the plurality of fold grippers are mounted to an arm support frame, wherein the arm support frame is positioned at a first location on a frame;

move at least one of the plurality of fold grippers from a first location on the arm support frame to a second location on the arm support frame thereby opening the first bag;

move the arm support frame from the first location on the frame to a second location on the frame so that the first bag covers an object;

open the plurality of fold grippers after moving the arm support frame to the second location on the frame;

move the arm support frame from the second location on the frame to the first location on the frame;

move the at least one of the plurality of fold grippers from the second location on the arm support frame to the first location on the arm support frame;

close, with an actuator of the electronic device, a plurality of bag grippers on the first bag, wherein the plurality of bag grippers are mounted to the arm support frame;

close the plurality of fold grippers on the plurality of folds of a second bag attached to the first bag; and move the at least one of the plurality of fold grippers from the first location on the arm support frame to the second location on the arm support frame thereby separating the first bag from the second bag and opening the second bag.

* * * * *